US007715764B2

(12) United States Patent
Aimoto

(10) Patent No.: US 7,715,764 B2
(45) Date of Patent: May 11, 2010

(54) DEVELOPING DEVICE WITH PULSATION DEVELOPER FLOW AND IMAGE FORMING APPARATUS

(75) Inventor: Toyoka Aimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 280 days.

(21) Appl. No.: 11/937,952

(22) Filed: Nov. 9, 2007

(65) Prior Publication Data

US 2008/0112731 A1 May 15, 2008

(30) Foreign Application Priority Data

Nov. 9, 2006 (JP) ..... P2006-304558

(51) Int. Cl.
*G03G 15/08* (2006.01)

(52) U.S. Cl. ..... 399/254; 399/256

(58) Field of Classification Search ..... 399/254, 399/255, 256, 258, 263
See application file for complete search history.

(56) References Cited

U.S. PATENT DOCUMENTS

2004/0179856 A1 9/2004 Nishiyama
2004/0179865 A1 9/2004 Nishiyama
2004/0265009 A1 * 12/2004 Shigeta et al. ..... 399/254

FOREIGN PATENT DOCUMENTS

| | | |
|---|---|---|
| CN | 1530762 A | 9/2004 |
| JP | 10-228175 | 8/1998 |
| JP | 2002-006631 | 1/2002 |
| JP | 2004-151354 A | 5/2004 |
| JP | 2005-99134 | 4/2005 |
| JP | 2006-220852 | 8/2006 |

* cited by examiner

*Primary Examiner*—Hoang Ngo
(74) *Attorney, Agent, or Firm*—Nixon & Vanderhye, PC

(57) ABSTRACT

In a developing device including a developer tank having a developing area tank and an agitating tank, a first agitating member, a second agitating member, a toner hopper, and a toner storing container, a toner replenishing port is formed in an agitating tank, and two flows of the developer are produced by a rotation of the first agitating member provided with a first agitating blade and a second agitating blade, from both ends of a longitudinal direction of the developer tank to a vicinity of the toner replenishing port. These two flows collides with each other in a vicinity of the toner replenishing port to produce a pulsation flow of the developer from the toner replenishing port into the toner storing container through the toner hopper.

16 Claims, 5 Drawing Sheets

DEVELOPING DEVICE WITH PULSATION DEVELOPER FLOW AND IMAGE FORMING APPARATUS

CROSS-REFERENCE TO RELATED APPLICATION

This application claims priority to Japanese Patent Application No. 2006-304558, which was filed on Nov. 9, 2006, the contents of which are incorporated herein by reference in its entirety.

BACKGOUND OF THE TECHNOLOGY

1. Field of the Technology

The present technology relates to a developing apparatus and an image forming apparatus.

2. Description of the Related Art

In an image forming apparatus for electrophotographically forming an image (hereinafter, occasionally referred to as merely an "image forming apparatus"), for example, a toner contained in a two-component developer (hereinafter, occasionally referred to as merely a "developer") is supplied from a developing device onto an electrostatic latent image on a surface of a photoreceptor to form a toner image, and the toner image is transferred and fixed onto a recording medium to form an image. The supply of the toner from the developing device to the electrostatic latent image is carried out via a developer bearing member from a developer tank as a toner storing container. The image forming apparatus is capable of forming a high-definition image with a simple operation and is easy to maintain. Therefore, the image forming apparatus has been widely used for a copying machine, a printer, and a facsimile. Accordingly, the image forming apparatus requires further improvement in its performance. Among the most important is to enhance an image forming speed to increase a number of images to be formed per unit time. There are different problems with a speed-up of the image forming speed, including, for example, an increase in a lifetime of a carrier contained in a developer. The developer contains a toner and a carrier. The carrier has a function for rubbing a toner while being agitated in the developing device to charge the toner. A high-definition image may be formed by charging the toner in an appropriate manner. Although the toner is continuously replenished depending on its consumption state, the same carrier is typically used until an end of its useful time. An image forming at a high speed requires an increased amount of consumption of the toner, and thereby the carrier is constantly rubbed by the toner, providing significant physical and mechanical stress on the carrier. As a result, a uniform charge amount of the toner is not achieved, causing a charge failure of the toner. Accordingly, an image concentration of a formed image becomes unstable. In addition, there is raised a problem in which a useful time of the carrier is finished in a short time period, thereby increasing a frequency of maintenance to replace the carrier.

To solve such problems, for example, improvement of the developer tank is attempted. In a typical developing device, the developer tank and the developer bearing member having a substantially same length are disposed in parallel to each other. In an improved technology, there is proposed a developer tank having a developing area as a portion which faces the developer bearing member of the developer tank, and an agitating area as an extending portion, by extending one end of a longitudinal direction of the developer tank. In an internal space of the developer tank, two screw members as an agitating transporting member are provided in parallel to each other in a longitudinal direction of the developer tank, and a toner is replenished from a toner replenishing port formed on a developer tank wall in the agitating area into the agitating area. In the developer tank, the developer is mixed with the newly-replenished toner by a rotational drive of the screw members in the agitating area, and then is transported from the agitating area to the developing area in a longitudinal direction of the developer tank. Then, the developer comes into contact with the developer bearing member in the developing area, and then is transported from the developing area to the transporting area in a longitudinal direction of the developer tank. That is, there is formed a transporting path in which the developer as a mixture of the toner and the carrier is reciprocated in a longitudinal direction of the developer tank. The toner and the carrier are uniformly mixed by this configuration. In addition, even when a toner consumption is increased for a high-speed image forming, the toner is rubbed by the carrier over a comparatively long distance, and is thereby sufficiently charged. In addition, physical stress and mechanical stress on the carrier may be reduced, thereby allowing a replacement time of the carrier to be extended.

There is conventionally adopted a method for falling the toner into the developer tank from a toner hopper provided on an upper side of a vertical direction of the developer tank, regardless of a configuration of the developer tank, when the toner is replenished into the developer tank. In the falling method, the aggregated toner is often replenished into the developer tank. However, the developer tank is designed to replenish the toner in a powdered state. Therefore, when the aggregated toner is replenished in the configuration improved as described above, the toner is not uniformly mixed with the developer in the developer tank, easily causing a non- uniform mixture. The non-uniform mixture leads to a non- uniform charge amount of the toner, causing various kinds of image failures.

In addition, in order to prevent a charge failure of the toner due to the deteriorated carrier, there is proposed a developing device using a trickle system. In the trickle system, a mixture of the toner and the carrier is replenished into the developer tank, and the excessive developer containing the deteriorated carrier is discharged from a developer discharging port formed in the developer tank to an outside of the developer tank. Accordingly, the deteriorated carrier is gradually replaced with the fresh carrier, preventing a charge failure of the toner due to the deteriorated carrier from occurring. As a specific example of the developing device using the trickle system, for example, in Japanese Unexamined Patent Publication JP-A 2005-99134, there is proposed a developer tank comprising the developer bearing member, the developing area and the agitating area divided by a partition wall, the developer tank having ,he developer discharging port formed thereon, and the agitating transporting member. In the developing device disclosed in JP-A 2005-99134, a mixture of the toner and the carrier is replenished into the developer tank. The agitating transporting member includes a first transporting portion having comparatively large transporting ability for the developer, and a second transporting portion having comparatively small transporting ability, in which the second transporting portion is arranged opposed to the developer discharging port. In addition, the first transporting portion transports the developer in a circulating direction of the agitating area, and the second transporting portion transports the developer in a direction opposite to the circulating direction of the agitating area. According to this configuration, a flow of the developer by the first transporting portion and a flow of the developer by the second transporting portion collides with each other around the developer discharging port, and thereby the excessive developer is stably discharged to an outside of the developer tank. With the technology disclosed in JP-A 2005-99134, there is solved a problem in which in the developing device using the trickle system an amount of the developer discharged to an outside of the developer tank becomes unstable. However, even for the developing device as described above, there is adopted a method for falling the mixture of the toner and the carrier from the toner storing container provided on an upper side of a vertical direction of the developer tank. Therefore, there is not solved a problem in which the non-uniform mixture occurs when the toner and the carrier in an aggregated state falls into the developer tank.

SUMMARY OF THE TECHNOLOGY

An object of the technology is to provide a developing device employing a falling manner to supply a toner into a developer tank, in which it is prevented that toner is aggregated and falls to cause a non-uniform mixture, allowing an image having no image failure, with the result that an image of high image concentration and high-definition image quality can be obtained, and as well as to an image forming apparatus having the same.

The technology provides a developing device provided in an image forming apparatus including a photoreceptor, for supplying a toner onto an electrostatic latent image on the photoreceptor, comprising:

a developer bearing member rotatably provided so as to face the photoreceptor, for supplying the toner onto the electrostatic latent image on the photoreceptor;

a developer tank including a developing area tank having a length substantially equal to a length in an axis line direction of the developer bearing member, for supplying a developer to the developer bearing member, and an agitating tank provided so as to be connected to the developing area tank, the agitating tank having a toner replenishing port for receiving the replenished toner;

a first agitating member rotatably supported by the developer tank so as to face the developer bearing member, the first agitating member having a length longer than a length of the developer bearing member in its axis line direction, and being provided so that one end thereof reaches a vicinity of one end of the agitating tank longitudinal direction, for agitating and transporting the developer from both ends of a longitudinal direction of the developer tank to the toner replenishing port;

a second agitating member rotatably supported by the developer tank so as to oppose the developer bearing member via the first agitating member, the second agitating member having a length longer than a length in the axis line direction of the developer bearing member, and being provided so that one end thereof reaches a vicinity of one end of a longitudinal direction of the agitating tank, for agitating the replenished toner along with the developer in the developer tank and transporting the mixture;

a toner storing container having a toner discharging port for discharging a stored toner to an outside thereof; and a toner hopper disposed so as to be connected to the toner storing container and developer tank, for supplying the developer tank with the toner received from the toner storing container, the toner hopper having a toner receiving port formed in communication with the toner discharging port of the toner storing container, and a toner supplying port formed in communication with the toner replenishing port of the developer tank.

According to the technology, there is provided the developing device which is provided in the image forming apparatus, comprising the developer bearing member, the developer tank, the first agitating member, the second agitating member, the toner storing container, and the toner hopper, and which supplies the toner onto the electrostatic latent image on the photoreceptor. In the developing device, the developer bearing member is rotatably provided so as to face the photoreceptor, and supplies the toner onto the electrostatic latent image on the photoreceptor. The developer tank includes the developing area tank and the agitating tank. Here, the developer tank has the length substantially equal to the length of the developer bearing member in its axis line direction, and supplies the developer to the developer bearing member, and the agitating tank is provided so as to be connected to the developing area tank having the toner replenishing port for receiving the replenished toner. The first agitating member is rotatably supported by the developer tank so as to face the developer bearing member, has the length longer than the length of the developer bearing member in its axis line direction, is provided so that the one end thereof reaches the vicinity of the end of the longitudinal direction of the agitating tank, and agitates and transports the developer from both ends of a longitudinal direction of the developer tank to the toner replenishing port. The second agitating member is rotatably supported by the developer tank so as to oppose the developer bearing member via the first agitating member, has the length longer than the length of the developer bearing member in its axis line direction, is provided so that the one end thereof reaches the vicinity of the end of a longitudinal direction of the agitating tank, and agitates the replenished toner along with the developer in the developer tank and transports the mixture. The toner storing container has therein the toner discharging port formed for discharging the stored toner. The toner hopper includes the toner receiving port and the toner supplying port, is provided so as to be connected to the toner storing container and the developer tank, and supplies the toner received from the toner storing container into the developer tank. Here, the toner supplying port is formed in communication with the toner discharging port of the toner storing container, and the toner supplying port is formed in communication with the toner replenishing port of the developer tank.

It is remarkable that the developing device includes a first agitating member. In the developer tank including a developing area tank, and an agitating tank connected thereto, the first agitating member agitates and transports the developer by its rotation from both ends of the developer tank, that is, an end on a side of the developing area tank opposite to a side thereof connected to the agitating tank of the developing area tank (hereinafter, unless otherwise noted, occasionally referred to as a "non-connected side end of the developing area") and an end on a side of the agitating tank opposite to a side thereof connected to the developing area tank of the agitating tank (hereinafter, unless otherwise noted, a "non-connected side end of the agitating tank"), to the toner replenishing port formed in the agitating tank. The developer tank is provided in communication with the toner hopper via the toner replenishing port and the toner supplying port formed in communication with the toner replenishing port. With this configuration a flow in a direction opposite to a flow of the developer collides with the flow of the developer around the toner replenishing port, producing a flow of the developer going to the toner storing container via the toner hopper. The first agitating member rotates mainly during an image forming operation, and thereby the toner in the developer tank is gradually consumed. Therefore, a flow of the toner going from the toner storing container to the developer tank via the toner hopper is produced. Accordingly, the flow of the developer going to the toner storing container once flows into the toner storing container, and then joins the flow of the toner going from the toner storing container to the developer tank, resulting in a flow going to the developer tank. As described above, the flow of the developer both from the developer tank to the toner storing container and from the toner storing container to the developer tank, through the toner replenishing port and the toner supplying port, that is, a pulsation flow of the developer is produced. This flow improves mixing efficiency of the developer and the toner, allowing the newly-supplied toner to be more uniformly mixed with the developer in the developer tank. In addition, this flow produced prevents the aggregated toner from falling into the developer tank, thus preventing the non-uniform mixture from occurring. Accordingly, the toner and the carrier are uniformly mixed in the developer tank. Therefore, it is possible to uniformly charge the toner, for example when an image is formed at a high-speed, and for a long time. As a result, the developing device, in the image forming apparatus, allows an image having no image failure, a high-image concentration, and a high-definition to be formed in a long-term and stable manner. Moreover, a toner charged with an opposite polarity, and an offset toner due to a charge failure are prevented, thereby offering advantages such as an extension of a service life of the photoreceptor, and a reduction in usage of the toner.

Further, it is preferable that the toner replenishing port is formed in a middle portion of a longitudinal direction of the agitating tank in the developer tank, and on an upper side of a vertical direction of the first agitating member.

The toner replenishing port is formed in the middle portion of the longitudinal direction of the agitating tank in the developer tank, and on the upper side of the vertical direction of the first agitating member. Accordingly, the pulsation flow of the developer is smoothly and continuously produced to further improve a uniform mixing property between the toner and the carrier, thereby further reducing a possibility of the non-uniform mixture. In particular, when an image is continuously formed at a high-speed and for a long time and the toner in the developer tank is rapidly consumed, the uniform mixing property between the newly-replenished toner and the developer in the developer tank is maintained, sufficiently allowing the toner to be charged to its designed charge value and to be uniformly charged. In addition, the toner replenishing port is formed in the portion described above, thereby increasing design flexibility of the developing device itself, allowing an effective arrangement with respect to space utilization of the developer tank, the toner hopper, and the toner storing container, and allowing a smaller size of the developing device and thus a main body of the image forming apparatus.

Further, it is preferable that the second agitating member transports the developer in a direction opposite to the direction of transporting the developer by the first agitating member, in an area from an end of a longitudinal direction of the developing area tank to a vicinity of the toner replenishing port, and transports the developer in a direction identical to the direction of transporting the developer by the first agitating member, in an area from an end of a longitudinal direction of the agitating tank to the vicinity of the toner replenishing port.

It is preferable that the second agitating member transports the developer in the direction opposite to the direction of transporting the developer by the first agitating member, in the area from the non-connected side end of the developing area tank to a vicinity of the toner replenishing port, and transports the developer in the direction identical to the direction of transporting the developer by the first agitating member, in the area from the non-connected side end of the agitating tank to the vicinity of the toner replenishing port. Accordingly, the pulsation flow of the developer to the toner hopper around the toner replenishing port is increased to further improve a mixing property between the developer in the developer tank and the toner in the toner hopper, further improving a replenishing property into the developer tank for the developer containing the toner and the carrier in a uniformly-mixed state. Accordingly, the flow of the developer in the developer tank becomes stable, and the toner supplied into the developer tank is gradually consumed, and a content of the deteriorated toner in such a state that a charge failure occurs is significantly decreased in the developer. Further, sticking efficiency of the developer to a surface of a developer bearing member is increased.

Further, it is preferable that the first agitating member and the second agitating member are screw-shaped agitating members including a rotating shaft rotatably supported by the developer tank, and an agitating blade spirally formed on an outer peripheral surface of the rotating shaft so as to extend in an axis line direction of the rotating shaft.

Use of the screw-shaped agitating member as the first agitating member and the second agitating member certainly produces the pulsation flow of the developer around the replenishing port, providing a desired effect of the technology.

Further, it is preferable that the first agitating member is a screw-shaped agitating member including a rotating shaft rotatably supported by the developer tank; a first agitating blade formed on an outer peripheral surface of the rotating shaft so as to spirally extend from one end of the rotating shaft on a side of the developing area tank opposite to a side thereof connected to the agitating tank in the developing area tank, for transporting the developer by a rotation of the rotating shaft in a direction from the end on the side opposite to the side thereof connected to the agitating tank in the developing area tank to the toner replenishing port; and a second agitating member formed on an outer peripheral surface of the rotating shaft so as to spirally extend from the other end of the rotating shaft on a side opposite of the agitating tank to a side thereof connected to the developing area tank in the agitating tank, and so that an end on a toner replenishing port side thereof is spaced from an end on a toner replenishing port side of the first agitating blade, for transporting the developer by the rotation of the rotating shaft in a direction from the end on the side of the agitating tank opposite to the side thereof connected to the developing area tank in the agitating tank to the toner replenishing port.

It is preferable that the first agitating member is a screw-shaped member including a rotating shaft, a first agitating blade, and a second agitating blade. The rotating shaft is rotatably supported by the developer tank. The first agitating blade is formed on an outer peripheral surface of the rotating shaft so as to spirally extend from one end of the rotating shaft on a side of the developing area tank opposite to a side thereof connected to the agitating tank in the developing area tank, and transports the developer by the rotation of the rotating shaft in the direction from the non-connected side end of the developing area tank to the toner replenishing port. The second agitating member is formed on an outer peripheral surface of the rotating shaft so as to spirally extend from the other end of the rotating shaft on a side of the agitating tank opposite to a side thereof connected to the developing area tank in the agitating tank, and so that the end on the toner replenishing port side thereof is spaced from the end on the toner replenishing port side of the first agitating blade, and transports the developer by the rotation of the rotating shaft in the direction from the non-connected side end of the agitating tank to the toner replenishing port. The toner replenishing port is adjacent to a gap between the first agitating blade and the second agitating blade. Accordingly, the pulsation flow of the developer is produced more certainly, providing an improved mixing property between the toner and the carrier, and an improved replenishing property of the toner into the developer tank.

Further, it is preferable that the second agitating member is a screw-shaped agitating member including a rotating shaft rotatably supported by the developer tank; a third agitating blade formed on an outer peripheral surface of the rotating shaft so as to spirally extend from one end of the rotating shaft on a side of the developing area tank opposite to a side thereof connected to the agitating tank in the developing area tank, for transporting the developer by the rotation of the rotating shaft in the direction from the toner replenishing port to the end on the side opposite to the side connected to the agitating tank in the developing area tank; and the fourth agitating member formed on the outer peripheral surface of the rotating shaft so as to spirally extend from the other end of the rotating shaft on a side of the agitating tank opposite to a side thereof connected to the developing area tank in the agitating tank, and so that an end on a toner replenishing port side thereof is spaced from an end on a toner replenishing port side of the third agitating blade, for transporting the developer by the rotation of the rotating shaft in a direction from the toner replenishing port to the end on the side of the agitating tank opposite to the side thereof connected to the developing area tank in the agitating tank.

It is preferable that the second agitating member is a screw-shaped member including a rotating shaft, a third agitating blade, and a fourth agitating blade. The rotating shaft is rotatably supported by the developer tank. The third agitating blade is formed on the outer peripheral surface of the rotating shaft so as to spirally extend from the one end of the rotating shaft on the side of the developing area tank opposite to the side thereof connected to the agitating tank in the developing area tank, and transports the developer by the rotation of the rotating shaft in the direction from the toner replenishing port to the non-connected side end of the developing area tank. The fourth agitating member is formed on the outer peripheral surface of the rotating shaft so as to spirally extend from the other end of the rotating shaft on the side of the agitating tank opposite to the side thereof connected to the developing area tank in the agitating tank, and so that the end on the toner replenishing port side thereof is spaced from the end on the toner replenishing port side of the third agitating blade, and transports the developer by the rotation of the rotating shaft in the direction from the toner replenishing port to the non-connected side end of the agitating tank. Accordingly, the pulsation flow of the developer by the first agitating member is smoothly and continuously produced. In addition, the flow of the developer in the developer tank becomes stable, and a series of processes such as replenishment of the toner into the developer tank, the mixture of the toner and the carrier, the supply of the developer to the developer bearing member smoothly proceed in parallel. Therefore, even in a state in which the developing device is overloaded, such as a high-speed image forming, a prolonged and continuous image forming with a large print ratio, it is possible to stably form images while maintaining image concentration and image quality at the high level.

Further, it is preferable that the developer tank, the toner hopper, and the toner storing container are provided in this order in a connected manner in the vertical direction, and the developer tank is disposed lowermost in the vertical direction. The developer tank, the toner hopper, and the toner storing container are provided in this order in a connected manner in a vertical direction, and the developer tank is disposed lowermost in the vertical direction. Accordingly, the replenishment of the toner becomes in particular smooth.

Further, it is preferable that the developer tank includes a developer discharging port formed for discharging the developer to an outside of the developer tank, and the toner stored in the toner storing container contains a carrier.

When a configuration is adopted to the developing device using a trickle system in which the developer discharging port for discharging the developer is formed in the developer tank, and the toner stored in the toner storing container contains the carrier, and a mixture of the toner and the carrier is replenished into the developer tank, the same effect as described above is obtained.

Further, the technology provides an image forming apparatus comprising:

a photoreceptor having an electrostatic latent image formed on a surface thereof;

a charging section for charging the surface of the photoreceptor;

an exposure section for forming the electrostatic latent image on the surface of the photoreceptor;

the above-mentioned developing device for supplying a toner onto the electrostatic latent image on the surface of the photoreceptor to form a toner image;

a transfer section for transferring the toner image on the surface of the photoreceptor onto a recording medium;

a cleaning section for cleaning up the surface of the photoreceptor; and a fixing section for fixing the toner image onto the recording medium.

There is provided an image forming apparatus comprising a photoreceptor, a charging section, an exposure section, a developing device, a transfer section, a cleaning section, and a fixing section. According to the image forming apparatus, it is possible to stably form images over a service life thereof while maintaining image concentration and image quality at the high level. In addition, when being set to form an image at a high-speed, the image concentration and the image quality in the image are not deteriorated. Further, compared with known image forming apparatuses, a toner consumption and thus running costs are reduced, thereby providing an economical advantage.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1A:
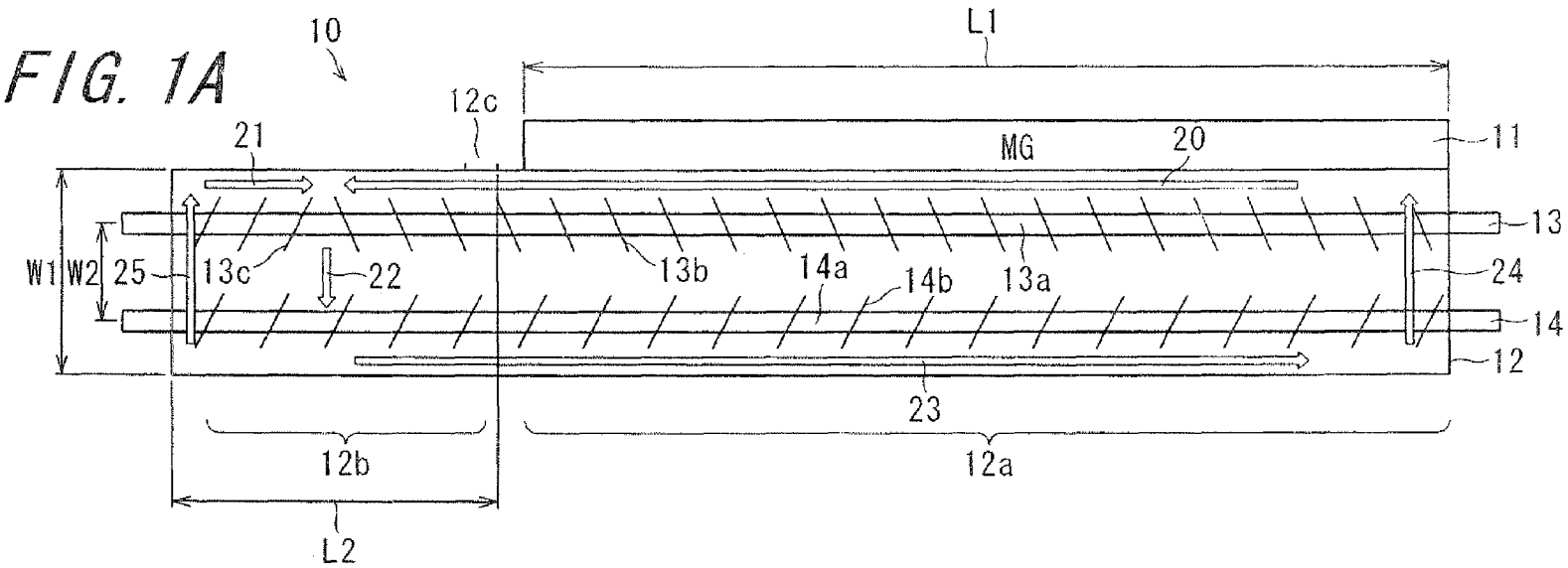
FIGS. 1A and 1B are a view schematically illustrating a configuration of a developing device according to a first embodiment, FIG. 1A being a top view illustrating an internal structure of a developer tank in the developing device, and FIG. 1B being a cross sectional view, viewed from an end side of an agitating tank, illustrating an internal structure of an agitating tank in the developing device.

Now referring to the drawings, preferred embodiments are described below.

Figure 1B:
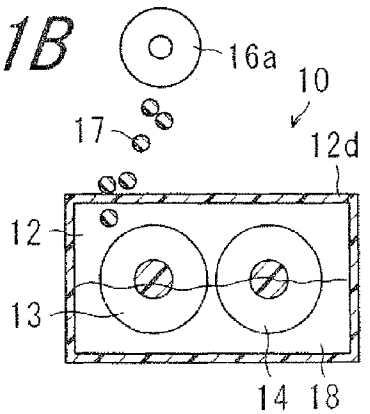
Figure 2:
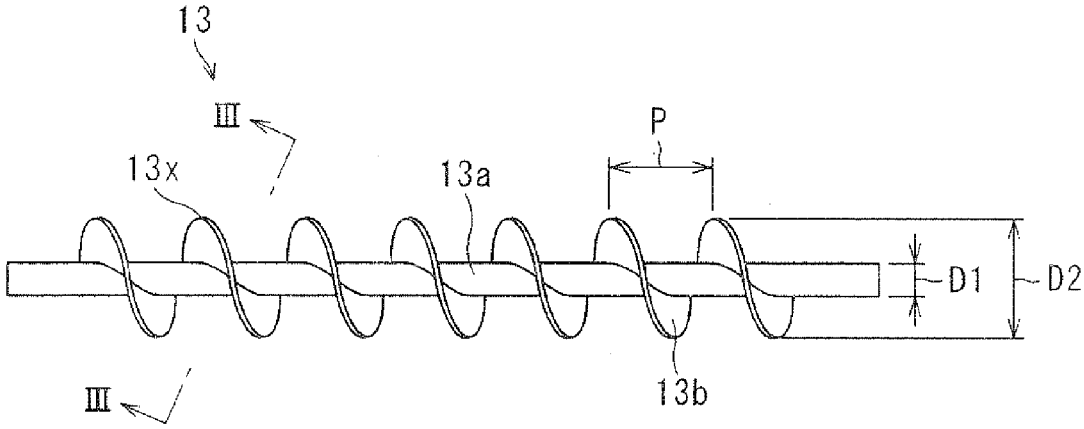
FIG. 2 is a side view illustrating a configuration of an essential part of a first agitating member.
Figure 3:
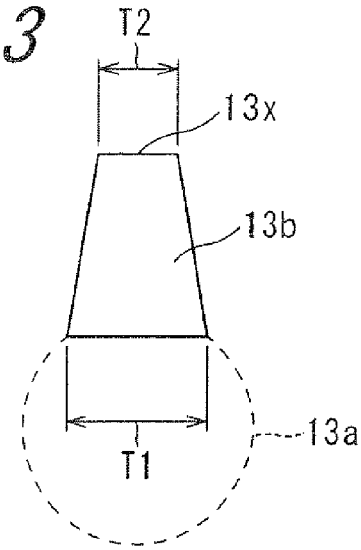
FIG. 3 is a cross sectional view taken on line III-III of an agitating blade of the first agitating member of FIG. 2.
Figure 4:
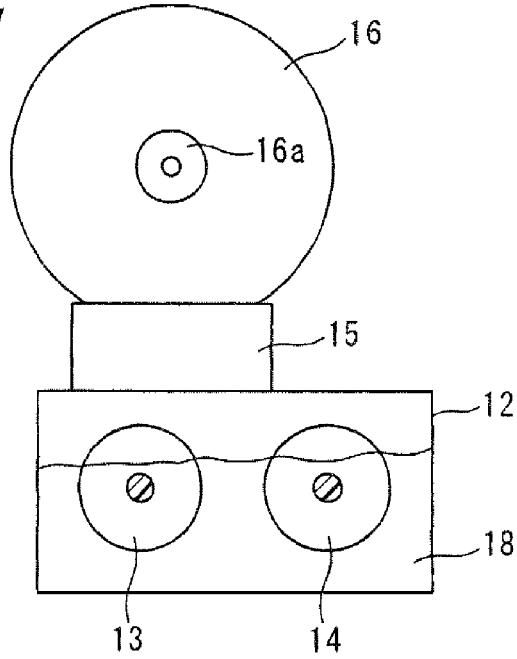
FIG. 4 is a side view viewed from an end of a longitudinal direction of the developing device of FIGS. 1A and 1B.
Figure 5:
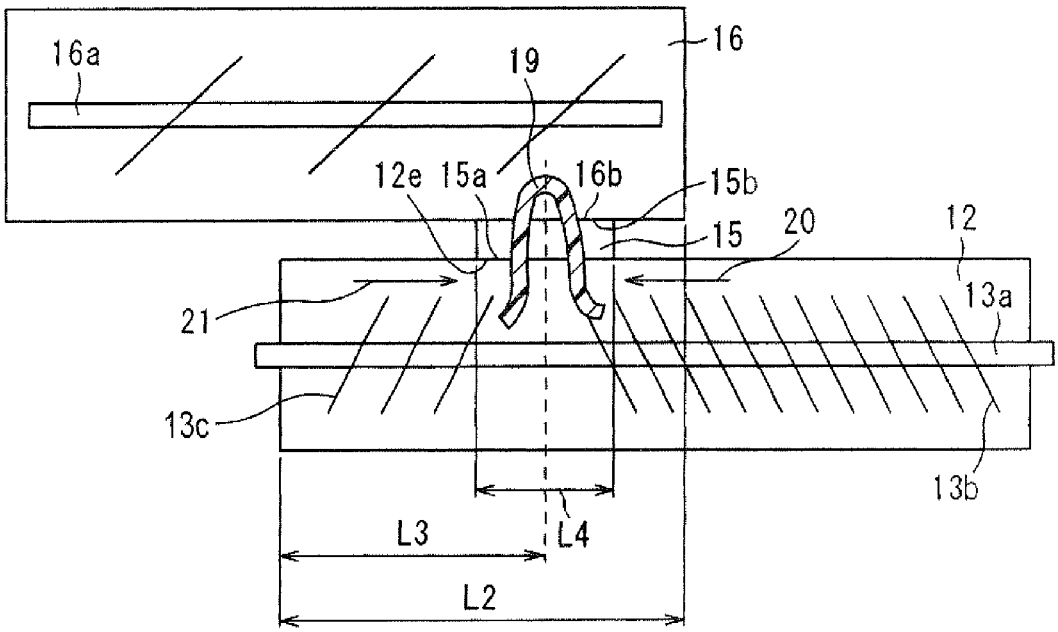
FIG. 5 is a cross sectional view describing a pulsation flow of a developer in the developing device of FIGS. 1A and 1B.

FIGS. 1A and 1B are a view schematically illustrating a configuration of a developing device 10 according to a first embodiment. FIG. 1A is a top view illustrating an internal structure of a developer tank 12 in the developing device 10. FIG. 1B is a cross sectional view, viewed from an end side of an agitating tank 12*b*, illustrating an internal structure of an agitating tank 12*b* in the developing device 10. Incidentally, in order to clearly show the internal structure of the developer tank 12 in FIG. 1A, a developer tank wall located in an upper part of a vertical direction of the developer tank 12 is not shown. In addition, in order to simplify a description in FIG. 1B, only an agitating member 16*a* in a toner storing container 16 is shown, and the toner storing container 16 and a toner hopper 15 are not shown. FIG. 2 is a side view illustrating a configuration of an essential part of a first agitating member 13. FIG. 3 is a cross sectional view taken on line III-III of an agitating blade 13*b* of the first agitating member 13. FIG. 4 is a side view viewed from an end of a longitudinal direction of the developing device 10. FIG. 5 is a cross sectional view describing a pulsation flow 19 of a developer in the developing device 10.

The developing device 10 is a developing device using a trickle system attached to an image forming apparatus 1 for forming an image using an electrophotographic system, in which a mixture 17 of a toner and a carrier is replenished into the developer tank 12, and an excessive developer is discharged from a developer discharging port 12*c* to an outside of the developer tank 12. The developing device 10 includes a developer bearing member 11, the developer tank 12, the first agitating member 13, a second agitating member 14, the toner hopper 15, and the toner storing container 16. In the embodiment, the technology is explained with a developing device employing a trickle system. But the present technology is not limited to the developing device employing a trickle system. In other words, it is not limited to a developing device having a developer discharging port 12*c* which discharges an excessive developer out of the developer tank 12.

The developer bearing member 11 is a roller-shaped member arranged so as to face a photoreceptor drum 2 which is a photoreceptor and so that an axis line thereof is in parallel to a rotating shaft line of the photoreceptor drum 2. In addition, the developer bearing member 11 is rotatably supported by the photoreceptor drum 2 and a device body of the developing device 10, and arranged so as to be rotatable by a driving mechanism (not shown). The developer bearing member 11 bears the developer on a surface thereof. In the embodiment, the developer bearing member 11, as in a case of the image forming apparatus 1 as another embodiment, is a magnet roller including a magnet member 30 and a developing sleeve 31. The magnet member 30 includes, for example, permanent magnet chips, has N poles and S poles arranged in an approximately alternate manner in a circumference direction thereof, and totally forms a cylindrical shape. The developing sleeve 31 is a cylindrical member composed of non-magnetic materials such as a synthetic resin, and is rotatably arranged on an outer periphery of the magnetic member 30 so as to enclose the magnetic member 30.

The developer borne on the developer bearing member 11 is a two-component developer containing the toner and the carrier. As the carrier, a magnetic material such as iron powder, and ferrite is used. In the embodiment, the toner having a volume average particle diameter of 7 μm, and the toner having a volume average particle diameter of 40 μm are used. The two-component developer presents on the developer bearing member 11 and in the developer tank 12, in a state in which the toner is attached onto a surface of the carrier. The two-component developer is attracted onto a surface of the developer bearing member 11, that is, the developing sleeve 31 by magnetic force of the magnetic member 30, to form a magnetic brush which is a series of ears composed of the two-component developer. As described above, the two-component magnetic brush is borne on the developing roller 11 in a form of the magnetic brush. The toner having a charge in the two-component developer forming the magnetic brush is supplied from the developing roller 11 onto the photoreceptor drum 2 by a potential difference between the developer roller 11 and the photoreceptor drum 2, to develop an electrostatic latent image and to form a toner image. Hereinafter, unless otherwise noted, the two-component developer is referred to as merely a "developer".

The developer tank 12 is a container-shaped member formed so that a length of a longitudinal direction of the developer tanks 12 is longer than a length L1 of the developer bearing member 11 in its axis line direction, and having an approximately rectangular parallelepiped shape in appearance. The developer tank 12 includes a developing area tank 12*a* and an agitating tank 12*b*. In the embodiment, a width W1 of the developer tank 12 in a direction perpendicular to a longitudinal direction of the developer tank 12 is 38 mm.

The developing area tank 12*a* is arranged so as to face the developer bearing member 11 over an entire length of the developer bearing member 11 and so that a length of the developing area tank 12*a* in its longitudinal direction is substantially equal to a length L1 of the developer bearing member 11 in its axis line direction, or is preferably a little longer than the L1, and supplies the developer onto the developer bearing member 11. Note that the length of the developing area tank 12*a* in its longitudinal direction is shorter than a length of the developer tank 12 in its longitudinal direction. A developer discharging port 12*c* is formed in the agitating tank 12*b*. More specifically, the developer discharging port 12*c* is formed so as to face the first agitating member 13, in a developer tank wall 12*d* on a more downstream side than the developer bearing member 11 in a direction of agitating and transporting the developer by the first agitating member 13 (i.e., a direction of an arrow 20).

The developer released from the developer bearing member 11 has a low toner concentration and a high carrier concentration, since the toner has been just supplied onto the electrostatic latent image on the photoreceptor drum 2. In addition, this carrier is subject to external stress by a regulating blade (not shown, a developer magnetic brush regulating member) arranged adjacent to a surface of the developer bearing member 11, and is thereby more deteriorated compared with the fresh carrier. The deterioration means a state that a coating layer on a surface of the carrier is peeled, or that the toner is firmly bonded onto the surface of the carrier (a spent). The above-described carrier cannot offer a normal charge to the toner, providing a decrease in image quality.

Figure 7:
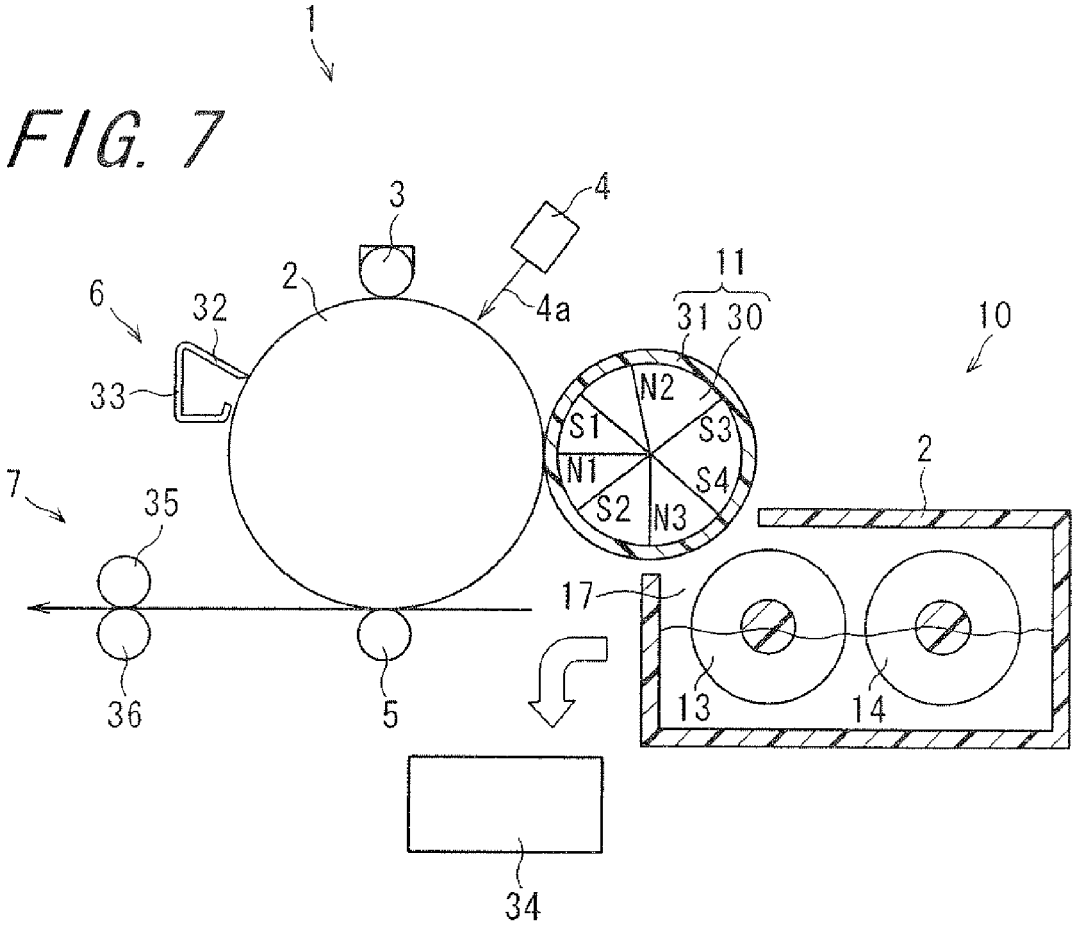
FIG. 7 is a cross sectional view schematically illustrating a configuration of an image forming apparatus according to another embodiment.

The developer which is released from the surface of the developer bearing member 11, and contains the deteriorated carrier in a high concentration, is transported by the first agitating member 13 in a direction of the arrow 20. Therefore, the developer discharging port 12*c* is formed in the vicinity on a downstream side of the developer bearing member 11 in the direction of the arrow 20, and thereby the deteriorated carrier may be discharged to an outside of the developer tank 12 in a substantially selective manner. The excessive developer overflowed from the developer discharging port 12*c* is stored in a recovering container 34 through a discharging path (not shown) provided in the outside of the developer tank 12 in communication with the developer discharging port 12*c*, and the stored developer is then recovered, as shown in FIG. 7.

The agitating tank 12*b* is arranged in a portion connected to the developing area tank 12*a* in a longitudinal direction of the developer tank 12, and other than a portion so as to face the developer bearing member 11 of the developer tank 12. This portion is a so-called extending portion of the developer tank 12. The agitating tank 12*b* agitates and transports the mixture 17 of the toner and the carrier replenished from the toner storing container 16 via the toner hopper 15 along with a developer 18 in the developer tank 12, and supplies the mixture into the developing area tank 12*a* and recovers the developer from the developing area tank 12*a*. A toner replenishing port 12*e* is arranged in a developer tank wall 12*d* in an upper part of a vertical direction of the agitating tank 12*b*, as shown in FIG. 5. The toner replenishing port 12*e* is preferably arranged in an approximately middle part of a longitudinal direction of the developer tank wall 12*d* of the agitating tank 12*b*, and is more preferably arranged in the approximately middle part of the longitudinal direction of the developer tank wall 12*d* of the agitating tank 12*b*, and on an upper side of a vertical direction of the first agitating member 13. In addition, the toner replenishing port 12*e* is formed in communication with a toner supplying port 15*a* formed on a lower surface of a vertical direction of the toner hopper 15 in a vertical direction. Accordingly, an internal space of the developer tank 12 and an internal space of the toner hopper 15 become communicated with each other.

With the configuration of the toner replenishing port 12*e* as described above, a flow of the developer 18 in the direction of the arrow 20 by a rotational drive of the first agitating member 13 as described later collides with a flow of the developer 18 in a direction of an arrow 21, in the vicinity of the toner replenishing port 12*e*, providing a pulsation flow 19 of the developer 18 as shown in FIG. 5. Meanwhile, the toner in the developer tank 12 is gradually consumed to produce a flow from the toner storing container 16 to the developer tank 12 through the toner hopper 15, due to an image forming operation in which the first agitating member 13 rotates. Therefore, the flow of the developer 18 going to the toner storing container 16 through the toner hopper 15 once flows into the toner storing container 16, and joins a flow of the toner going from the toner storing container 16 to the developer tank 12, to again produce a flow going to the developer tank 12. As described above, there is produced the flow of the developer from the developer tank 12 to the toner storing container 16, and from the toner storing container 16 to the developer tank 12, through the toner replenishing port 12*e* and the toner supplying port 15*a*, that is, the pulsation flow 19 of the developer. The pulsation flow 19 improves mixing efficiency between the developer and the toner, resulting that the newly-supplied toner is more uniformly mixed with the developer 18 in the developer tank 12. In addition, the pulsation flow 19 produced prevents the aggregated toner from falling into the developer tank 12, thus preventing a non-uniform mixture in the developer 18.

In the embodiment, a length L2 of a longitudinal direction of the agitating tank 12*b* is 150 mm. A length L3 from a non-connected side end (i.e., an end on a side opposite to a side connected to the developing area tank 12*a*) of the agitating tank 12*b* to a middle of the toner replenishing port 12*e* is 80 mm. Further, a length L4 of the toner replenishing port 12*e* in a longitudinal direction of the agitating tank 12*b* or the developer tank 12 is 40 mm.

The first agitating member 13 is a screw-shaped member which is arranged so as to face the developer bearing member 11 and so that an axis line thereof is in parallel to an axis line of the developer bearing member 11, is rotatably supported by the developer tank 12, and is rotated by a driving mechanism (not shown). In addition, the first agitating member 13 having a length longer than a length of the developer bearing member 11 in its axis line direction, is arranged so that one end of a longitudinal direction of the first agitating member 13 extends so as to reach the non-connected side end of the agitating tank 12*b*, and the other end of the longitudinal direction thereof extends so as to reach a non-connected side end of the developing area tank 12*a* (i.e., an end on a side opposite to a side connected to the agitating tank 12*b* of the developing area tank 12*a*).

The first agitating member 13 includes a rotating shaft 13*a*, a first agitating blade 13*b*, and a second agitating blade 13*c*, as shown in FIGS. 1A and 2. The rotating shaft 13*a* is rotatably supported by the developer tank 12, and is rotated about an axis line thereof by a driving mechanism (not shown). The first agitating blade 13*b* is arranged on an outer peripheral surface of the rotating shaft 13*a* so as to spirally extend from an end of a longitudinal direction of the rotating shaft 13*a* to reach the vicinity of the toner replenishing port 12*e*. The first agitating blade 13*b* rotates in association with a rotational drive of the rotating shaft 13*a* to transport the developer in a direction from the non-connected side end of the developing area tank 12*a* to the toner replenishing port 12*e*, that is, the direction of the arrow 20. The second agitating blade 13*c* is arranged on an outer peripheral surface of the rotating shaft 13*a* so as to spirally extend from the other end of a longitudinal direction the rotating shaft 13*a* on the non-connected side of the agitating tank 12*b* to reach the vicinity of the toner replenishing port 12*e*. In addition, an end of the second agitating blade 13*c* on a toner replenishing port 12*e* side is arranged so as to be spaced from an end of the first agitating blade 13*b* on the toner replenishing port 12*e* side. The second agitating blade 13*c* rotates in association with the rotational drive of the rotating shaft 13*a* to transport the developer in a direction from the non-connected side end of the agitating tank 12*b* to the toner replenishing port 12*e*, that is, the direction of the arrow 21. Accordingly, the flow of the developer in the direction of the arrow 20 collides with the flow of the developer in the direction of the arrow 20, in the vicinity of the toner replenishing port 12*e*, producing the pulsation flow 19 in which the developer flows into the toner storing container 16 and returns to the developer tank 12.

In the embodiment, a rotation number of the rotating shaft 13*a*, that is, a rotation number of the first agitating member 13 is 200 rpm. A diameter D1 of the rotating shaft 13*a* is 6 mm. And, a diameter D2 of the first agitating member 13 is 16 mm. A blade pitch P in the first agitating blade 13*b* is 22 mm. In addition, as shown in FIG. 3, the thickness of the first agitating blade 13*b* is formed so as to be gradually decreased as it extends from the outer peripheral surface of the rotating shaft 13*a* to an outward direction of the rotating shaft 13*a*. In the embodiment, a thickness T1 of the first agitating blade 13*b* on the outer peripheral surface of the rotating shaft 13*a* is 4 mm, and a thickness T2 at a blade top 13*x* is 1 mm. Note that the second agitating blade 13*c* has the same blade pitch P, the same thickness on the outer peripheral surface of the rotating shaft 13*a*, and the same thickness at the blade top as the first agitating blade 13*b*, except that it has a different spiral direction from the first agitating blade 13*b*.

The second agitating member 14 is a screw-shaped member which is arranged opposed to the developer bearing member 11 via the first agitating member 13, is rotatably supported by the developer tank 12, and is rotated about an axis line thereof by a driving mechanism (not shown). The second agitating member 14 is arranged in parallel to the first agitating member 13 and the developer bearing member 11, in a longitudinal direction of the second agitating member 14, respectively. In addition, the second agitating member 14 has a length longer than a length of the developer bearing member 11 in its axis line direction, and is arranged so that one end of a longitudinal direction of the agitating tank 12*b* extends so as to reach the non-connected side end of the agitating tank 12*b*, and the other end of a longitudinal direction of the developing area tank 12*a* extends so as to reach the non-connected side end of the developing area tank 12*a*. In addition, the second agitating member 14 includes a rotating shaft 14*a* and an agitating blade 14*b*. The rotating shaft 14*a* is rotatably supported by the developer tank 12, and is arranged so as to be rotated by a driving mechanism (not shown). The agitating blade 14*b* is formed on an outer peripheral surface of the rotating shaft 14*a* so as to spirally extend from the non-connected side end of the developing area tank 12*a* to reach the non-connected side end of the agitating tank 12*b*. The agitating blade 14*b* rotates in association with a rotation of the rotating shaft 14*a*, and transports the developer in a direction from the vicinity of the toner replenishing port 12*e* to a direction toward the non-connected side end of the developing area tank 12*a*, that is in a direction of an arrow 23. In the non-connected side end of the developing area tank 12*a*, the first agitating member 13 and the second agitating member 14 transport the developer in cooperation with each other in a direction from the vicinity of the second agitating member 14 to the vicinity of the first agitating member 13, that is, in a direction of an arrow 24. Moreover, in the non-connected side end of the developing area tank 12*b*, the first agitating member 13 and the second agitating member 14 also transport the developer in cooperation with each other in a direction from the vicinity of the second agitating member 14 to the vicinity of the first agitating member 13, that is, in a direction of an arrow 25.

In the embodiment, a rotation number of the second agitating member 14; diameters of the second agitating member 14*a* and the rotating shaft 14*a*; a blade pitch of the agitating blade 14*b*, a thickness of the agitating blade 14*a* on an outer peripheral surface of the rotating shaft 14*a*, and a thickness at a blade top of the agitating blade 14*a*; and the like are similar to those of the first agitating member 13. Further, in the embodiment, a width W2 between an axis line of the first agitating member 13 and an axis line of the second agitating member 14 is 19 mm.

The toner hopper 15 is a container-shaped member arranged so as to be connected to an upper part of a vertical direction of the agitating tank 12*b*, and having an internal space. The internal space of the toner hopper 15 temporarily stores the mixture 17 of the toner and the carrier. The toner hopper 15 is composed of, for example, a synthetic resin. The toner supplying port 15*a* and a toner receiving port 15*b* are formed in the toner hopper 15, as shown in FIG. 15. The toner receiving port 15*b* is formed in an upper part of a vertical direction of the toner hopper 15, in communication with a toner discharging port 16*b* formed in a lower part of vertical direction of the toner storing container 16 described later in a vertical direction. Accordingly, the internal space of the toner hopper 15 becomes communicated with the internal space of the toner storing container 16. The toner supplying port 15*a* is formed in a lower part of a vertical direction of the toner hopper 15, in communication with the toner replenishing port 12*e* formed in the developer tank 12 in a vertical direction. Accordingly, the internal space of the developer tank 12 becomes communicated with the internal space of the toner hopper 15. The toner hopper 15 temporarily stores the toner discharged from the toner storing container 16, and replenishes the toner into the developer tank 12 through the toner supplying port 15*a* and the toner replenishing port 12*e*. At this time, in the toner hopper 15, the pulsation flow 19 of the developer is produced in the vicinity of the toner supplying port 15*a*, and the mixture 17 of the toner and the carrier stored in the toner hopper 15 is uniformly mixed with the developer constituting the pulsation flow 19, and the resultant mixture is returned to the developer tank 12.

The toner storing container 16 is a container-shaped member arranged so as to be connected to an upper part of a vertical direction of the toner hopper 15, and having an internal space. In the toner storing container 16, the mixture 17 of the toner and the carrier is stored. The toner discharging port 16*b* is formed in a lower part of a vertical direction of the toner storing container 16. In addition, the toner storing container 16 includes an agitating member 16*a*. The agitating member 16*a* is a screw member rotatably supported by the toner storing container 15, and arranged in the vicinity on an upper side of a vertical direction of the toner discharging port 16*b*. The agitating member 16*a* is arranged so as to be rotated by a driving mechanism (not shown) while rubbing the toner discharging port 16*b*. When the agitating member 16*a* is rotated, the mixture 17 of the toner and the carrier in the toner storing container 16 falls down from the toner discharging port 16*b* into the toner hopper 15. In response to the falling, the pulsation flow 19 started from the vicinity of the toner replenishing port 12*e* of the developer tank 12 and flowing to the toner storing container 16 starts to flow toward the developer tank 12 again. The toner storing container 16 may be configured with a cartridge system to be arranged in a removable manner against a main body of the image forming apparatus 1 described later, or may be configured using a fixed type with a system to fill up the mixture 17 from an outside when the mixture 17 has been consumed.

The mixture 17 of the toner and the carrier is replenished by, for example, detecting a toner concentration of the developer 18 in the developing area tank 12*a* by a toner concentration detecting sensor (not shown) provided in the developing area tank 12*a*. The toner concentration sensor detects the toner concentration in the developer 18 in the developing area tank 12*a* at a predetermined time interval. During an image forming operation, a detecting interval of the toner concentration using the toner concentration detecting sensor may be decreased. The toner concentration sensor is electrically connected to a control unit (not shown) provided in the image forming apparatus 1 having the developing device 10 attached, and a detection result by a toner concentration detecting section is inputted to the control unit. In accordance with the detection result inputted, the control unit sends a control signal to a driving mechanism for rotating the agitating member 16*a* to rotate the agitating member 16*a*, when the toner concentration of the developer 18 in the developing area tank 12*a* is less than a toner concentration set upon a device design. A rotation number of the agitating member 16*a* is determined in the control unit based on a difference between the detected toner concentration and the set toner concentration. This information is included in the control signal. Incidentally, the mixture 17 may be continuously replenished during the image forming operation. In addition, here, control by the control unit provided in the image forming apparatus 1 is, but not exclusively, described, and a control unit especially used for the developing device 10 may be provided to carry out the control as described above.

The developing device 10 includes a layer thickness regulating member (not shown). The layer thickness regulating member is a plate member arranged so that one end of a shorter side direction of the layer thickness regulating member is supported by the developer tank 12, and the other end thereof has a predetermined gap with a surface of the developer bearing member 11. The layer thickness regulating member regulates a layer thickness of a developer layer borne on the surface of the developer bearing member 11.

According to the developing device 10, in the developer tank 12, the first agitating member transports the developer 18 by a rotation thereof from the non-connected side end of the developing area tank 12*a* to the toner replenishing port 12*e*, and transports the developer 18 from the non-connected side end of the agitating tank 12*b* to the toner replenishing port 12*e*, and thereby the flows of the developer 18 in opposite directions collides with each other in the vicinity of the toner replenishing port 12*e*. This collision produces the pulsation flow 19 of the developer 18 from the developer tank 12 into the toner hopper 15, and then from the toner hopper 15 into the developer tank 12, through the toner replenishing port 12*e*. Accordingly, mixing ability between the developer 18 in the developer tank 12 and the newly-replenished mixture 17 of the toner and the carrier is significantly improved. Therefore, even in a state in which the large amount of toner is consumed in a short time, as in a case of an image forming at a high-speed, the toner and the carrier are constantly and uniformly mixed, preventing a charge failure of the toner, and thus allowing an image having no various image failures due to the charge failure of the toner, a high image concentration, and high-definition quality to be stably formed.

Figure 6:
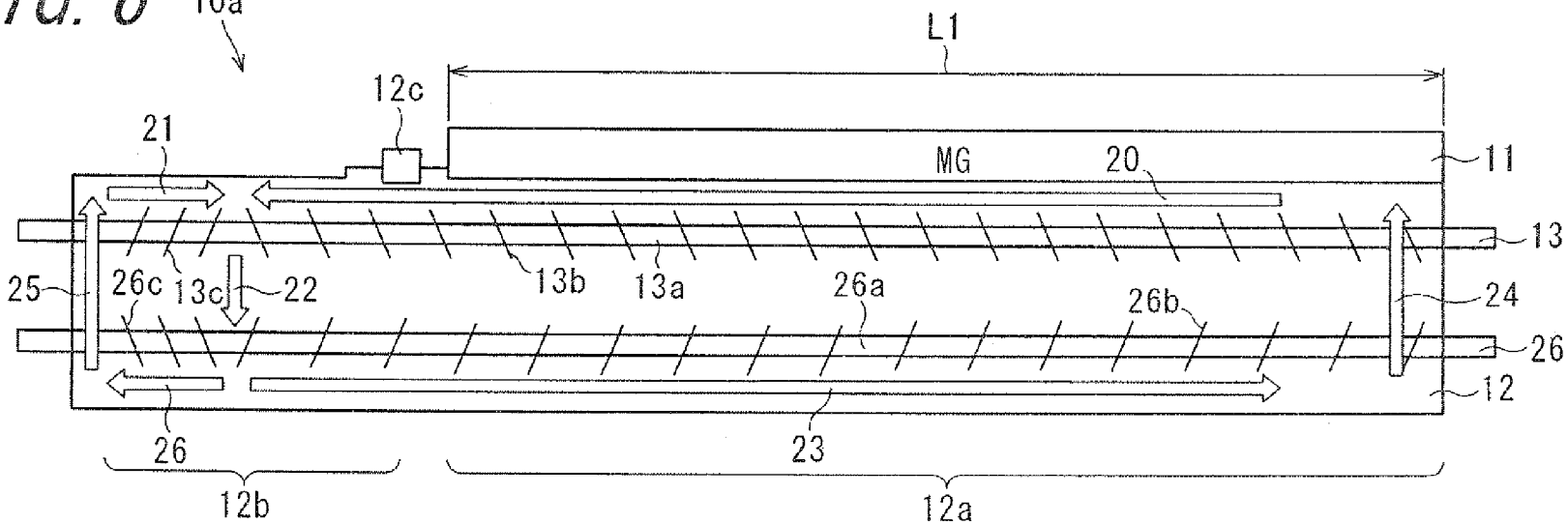
FIG. 6 is a top view schematically illustrating a configuration of an essential part of the developing device according to a second embodiment.

FIG. 6 is a top view schematically illustrating a configuration of an essential part of a developing device 10*a* according to a second embodiment. Incidentally, in order to clearly show an internal structure of the developer tank 12 in FIG. 6, a developer tank wall provided in an upper part of a vertical direction of the developer tank 12 is not shown. The developing device 10*a* is similar to the developing device 10, portions corresponding to the developing device 10 will be denoted by the same reference numerals and the common description will be omitted, or the common graphic display will be omitted. The developing device 10*a* includes a second agitating member 26 in place of the second agitating member 14, and any other configurations of the developing device 10*a* are similar to those of the developing device 10.

The second agitating member 26 is a screw-shaped member which is arranged so that an axis line thereof is in parallel to an axis line of the first agitating member 13, is rotatably supported by the developer tank 12, and is rotated by a driving mechanism (not shown). The second agitating member 26 has a length longer than a length of the developer bearing member 11 in its axis line direction, and is arranged so that one end of a longitudinal direction of the agitating tank 12*b* extends so as to reach the non-connected side end of the agitating tank 12*b*, and the other end of a longitudinal direction of the developing area tank 12*a* extends so as to reach the non-connected side end of the developing area tank 12*a*.

In addition, the second agitating member 26 includes a rotating shaft 26*a*, a third agitating blade 26*b*, and a fourth agitating blade 26*c*. The rotating shaft 26*a* is rotatably supported by the developer tank 12, and is rotated about an axis line thereof by a driving mechanism (not shown). The third agitating blade 26*b* is formed on the outer peripheral surface of the rotating shaft 26*a* so as to spirally extend from one end of a longitudinal direction of the rotating shaft 26*a* on the non-connected side of the developing area tank 12*a* to reach the vicinity of the toner replenishing port 12*e*. The third agitating blade 26*b* rotates in association with a rotation of the rotating shaft 26*a*, and transports the developer in a direction from the toner replenishing port 12*e* to a direction toward the non-connected side end of the developing area tank 12*a*, that is, in a direction of the arrow 23. The fourth agitating blade 26*c* is formed on the outer peripheral surface of the rotating shaft 26*a* so as to spirally extend from the other end of a longitudinal direction of the rotating shaft 26*a* on the non-connected side of the agitating tank 12*b* to reach the vicinity of the toner replenishing port 12*e*. The fourth agitating blade 26*c* rotates in association with a rotation of the rotating shaft 26*a*, and transports the developer in a direction from the toner replenishing port 12*e* to a direction toward the non-connected side end of the agitating tank 12*b*, that is, in a direction of an arrow 23. In the non-connected side end of the developing area tank 12*a*, the first agitating member 13 and the second agitating member 26 transport the developer in cooperation with each other in a direction from the vicinity of the second agitating member 26 to the vicinity of the first agitating member 13, that is, in a direction of the arrow 24. Moreover, in the non-connected side end of the developing area tank 12*b*, the first agitating member 13 and the second agitating member 26 also transport the developer in cooperation with each other in a direction from the vicinity of the second agitating member 26 to the vicinity of the first agitating member 13, that is, in a direction of the arrow 25.

In the embodiment, a rotation number of the second agitating member 26; diameters of the second agitating member 26 and the rotating shaft 26*a*; blade pitches in the third agitating blade 26*b* and the fourth agitating blade 26*c*; a thickness of the agitating blade on an outer peripheral surface of the rotating shaft 26*a*, and a thickness at a blade top of the agitating blade; and a distance between an axis line of the first agitating member 13 and an axis line of the second agitating member 26 are similar to those of the developing device 10. According to the developing device 10*a*, the second agitating member 26 includes the third agitating blade 26*b* and the fourth agitating blade 26*c*, thereby increasing the flows of the developer in directions of the arrows 22, 26, 26 and 21. As a result, the flow of the pulsation flow 19 (a flow speed, a flow width, etc.) is further increased to further increase agitating efficiency between the newly-replenished mixture 17 of the toner and the carrier and the developer 18 in the developer tank 12, thereby providing improved replenishing ability of the mixture 17 and improved charge uniformity of the toner.

FIG. 7 is a cross sectional view schematically illustrating a configuration of an image forming apparatus 1 according to another embodiment. The image forming apparatus 1 forms an image on a recording medium such as a recording sheet in accordance with image information included in a print instruction from an external device. As the external devices, electrical and electronic devices capable of forming or obtaining the image information, and being electrically connected to the image forming apparatus 1 may be used, and examples thereof include a computer, a digital camera, a TV set, a video recorder, DVD recorder, and a facsimile. The image forming apparatus 1 comprises a photoreceptor drum 2, a charging section 3, an exposure section 4, a developing device 10, a transfer section 5, a cleaning section 6, and a fixing section 7.

The photoreceptor drum 2 is a roller-shaped member supported so as to be rotatable about an axis line thereof by a driving mechanism (not shown), and having a surface of a photosensitive film on which an electrical latent image and thus a toner image is formed. The photoreceptor drum 2 can use a roller-shaped member including, for example, a conductive substrate (not shown) and a photosensitive film (not shown) formed on a surface of the conductive substrate. As the conductive substrate, there can be used conductive substrates having a cylindrical shape, a columnar shape, and a thin film sheet shape. Among these substrates, preferable is the conductive substrate having a cylindrical shape. As the photosensitive film, examples thereof include an organic photosensitive film, and an inorganic photosensitive film. As the organic photosensitive film, examples thereof include a laminated body of a charge generating layer as a resin layer containing a charge generating substance, and a charge transporting layer as a resin layer containing a charge transporting substance; and a resin layer containing a charge generating substance and a charge transporting substance in one resin layer. As the inorganic photosensitive film, examples thereof include a film containing one or two or more selected from zinc oxide, selenium, and amorphous silicon. An undercoat film may be disposed between the conductive substrate and the photosensitive film, and a surface film (a protective coat) for mainly protecting the photosensitive film may be provided on a surface of the photosensitive film.

The charging section 3 is a roller-shaped member arranged so as to be rotatable about an axis line thereof by a driving mechanism (not shown), and in contact with the photoreceptor drum 2. A power supply (not shown) is connected with the charging section 3, and applies a voltage to the charging section 3. The charging section 3 receives application of a voltage from the power supply, and charges a surface of the photoreceptor drum 2 to a predetermined polarity and potential. In the embodiment, a charging roller for applying a charge to a surface of the photoreceptor drum 2 while contacting the surface thereof is, but not exclusively, used for the charging section 3, and for example, a corona charging device, a brush type charging device, and a charger type charging device may be used.

The exposure section 4 irradiates the surface of the photoreceptor drum 2 with a signal light beam 4*a* in accordance with image information to form an electrostatic latent image corresponding to the image information. The image information is included in a print instruction inputted to the image forming apparatus 1. In the embodiment, a laser scanning unit (not shown, hereinafter occasionally referred to as an "LSU") is used for the exposure section 4. The LSU includes a laser emitting section, and a laser reflecting section. The laser emitting section emits the signal light beam 4*a* in accordance with the image information. A semiconductor laser is, but not exclusively, used for the laser emitting section, and an electroluminescence (EL) element, and a light-emitting diode (LED) element may be used. The laser reflecting section reflects the signal light beam 4*a* emitted from the leaser emitting section to allow the reflected light to reach the surface of the photoreceptor drum 2. Accordingly, the electrostatic latent image in accordance with the image information is formed on the surface of the photoreceptor drum 2. A reflecting mirror may be used for the laser reflecting section.

The developing device 10 is the developing device as shown in FIGS. 1A and 1B, and supplies the toner onto the electrostatic latent image on the surface of the photoreceptor drum 2 to form a toner image. The developer bearing member 11 is a magnet roller including the magnetic member 30 and the developing sleeve 31. A power supply (not shown) is connected to the developing bearing member 11. The developer bearing member 11 is rotated while bearing the developer 18 on the surface thereof mainly by magnetic force and electrical force. Then, the developer bearing member 11 supplies the toner onto the electrostatic latent image on the surface of the photoreceptor drum 2 under application of a developing bias voltage by the power supply (not shown), in a most adjacent portion to the photoreceptor drum 2 (a developing nip portion). The developer tank 12 storing the developer 18 rotatably supports the first agitating member 13 and the second agitating member 14. In addition, the excessive developer discharged from the developer discharging port 12*c* of the developer tank 12 is stored in the recovering container 34 through the discharging path (not shown) provided in the outside of the developer tank 12 in communication with the developer discharging port 12*c*, and is then recovered.

The transfer section 5 is a roller-shaped member rotatably supported by a supporting section (not shown), arranged so as to be rotatable by a driving mechanism, and arranged in pressure-contact with the surface of the photoreceptor drum 2. A pressure-contact portion between the transfer section 5 and the photoreceptor drum 2 is a transfer nip portion. For the transfer section 5, there is used a roller-shaped member including, for example, a metal cored bar having a diameter of 8 mm to 10 mm, and a conductive elastic layer formed on a surface of the metal cored bar. As metal forming the metal cored bar, stainless steal, aluminum may be used. As the conductive elastic layer, there is used a rubber material obtained by compounding a conductive material such as carbon black with a rubber material such as ethylene-propylene rubber (EPDM), EPDM foam, and urethane foam. A power supply (not shown) is connected to the transfer section 5, and applies a transfer bias voltage to the transfer section 5 when the toner image on the surface of the photoreceptor drum 2 is transferred onto the recording medium. The transfer bias voltage is a voltage having a polarity opposite to a charge polarity of the toner constituting the toner image. Application of the transfer bias voltage leads to a smooth transfer of the toner image onto the recording medium. In the transfer section 5, the recording medium is fed sheet by sheet from a paper feeding tray (not shown) through a pickup roller and a regist roller while the toner image is transported by a rotation of the photoreceptor drum 2. The recording medium passes through the transfer nip portion and thereby the toner image on the surface of the photoreceptor drum 2 is transferred onto the recording medium. According to the transfer section 5, the toner image on the surface of the photoreceptor drum 2 is transferred onto the recording medium.

The cleaning section 6 includes a cleaning blade 32 and a toner storing tank 33. The cleaning blade 32 is a plate member arranged so as to extend in parallel to a longitudinal direction of the photoreceptor drum 2 and so that one end of a shorter side direction of the cleaning blade 32 is in contact with the surface of the photoreceptor drum 2, for removing from the surface of the photoreceptor drum 2 the residual toner remaining on the surface of the photoreceptor drum 2 after the toner image has been transferred onto the recording medium, and paper powder from the recording medium. The toner storing tank 33 is a container-shaped member having an internal space, and temporarily stores the toner removed by the cleaning blade 32.

The fixing section 7 includes a fixing roller 35 and a pressure roller 36. The fixing roller 35 is a roller-shaped member rotatably supported by a supporting section (not shown), and is arranged so as to be rotatable about an axis line thereof by a driving mechanism (not shown). The fixing roller 35 includes a heating section (not shown) therein, and heats and fuses the toner constituting the unfixed toner image borne on the recording medium transported from the transfer nip portion to fix the toner onto the recording medium. As the fixing roller 35, for example, a roller-shaped member including a cored bar and an elastic layer is used. The cored bar is composed of metal such as iron, stainless, and aluminum. The elastic layer is composed of an elastic material such as silicone rubber, and fluorine-contained rubber. In the embodiment, a roller-shaped member having a silicone rubber layer formed on a surface of an aluminum cored bar is used for the fixing roller 35. The heating section receives application of a voltage from a power supply (not shown) to be heated. As the heating section, a halogen lamp and an infrared lamp may be used.

The pressure roller 36 is a roller-shaped member rotatably supported, and is arranged in pressure-contact with the fixing roller 35 by a pressure section (not shown). The pressure roller 36 is rotated by a rotation of the fixing roller 35. A pressure-contact portion between the fixing roller and the pressure roller is a fixing nip portion. The pressure roller 36 presses the toner in a molten state against the recording medium to allow the toner image to be fixed onto the recording medium, when the toner image is heated and fixed onto the recording medium by the fixing roller 35. The heating section may be provided also in the pressure roller 36. The heating section similar to the heating section used in the fixing roller 35 may be used for the pressure roller 36. A roller-shaped member having the same configuration as the fixing roller 35 may be used for the pressure roller 36. In the embodiment, as the pressure roller 36, there is used a roller-shaped member having a silicone rubber layer formed on a surface of an iron cored bar.

According to the fixing section 7, the recording medium having the toner image transferred thereon is passed through the fixing nip portion to fuse the toner constituting the toner image and press the toner against the recording medium. Accordingly, the toner image is fixed onto the recording medium, and an image is printed. The recording medium having the image printed thereon is discharged and loaded onto a paper receiving tray arranged on an upper surface or on a side surface of a vertical direction of the image forming device 1, by a transporting section (not shown).

The control unit is arranged, for example, in an upper part of an internal space of the image forming apparatus 1, and includes a storage portion, a calculation portion, and a control portion. Various kinds of information for controlling an operation of the image forming apparatus 1 are stored in the storage portion. Such information includes various kinds of setting values set via a displaying section (not shown) disposed on an upper surface of the image forming apparatus 1, setting values for controlling operations of the respective members of the image forming apparatus 1, detection results from sensors disposed at various positions inside the image forming apparatus 1, image information included in a print instruction from an external device, and programs for controlling operations of the respective members. As the storage portion, memory devices commonly used in this field may be used, and examples thereof include a read only memory (ROM), a random access memory (RAM), and a hard disk drive (HDD). The calculation portion takes out various kinds of data (an image forming instruction, a detection result, image information, etc.) inputted to the storage portion, and programs of the various kinds of sections to make various kinds of determinations. The control portion sends a control signal to a corresponding device depending on the determination result by the calculation portion to carry out operation control. The control portion and the calculation portion include a processing circuit realized by a microcomputer and a microprocessor having a central processing unit (abbreviated as CPU). The control unit includes a main power supply along with the storage portion, the calculation portion, and the control portion.

A black solid image was printed on a A4-size recording sheet at a print ratio of 10%, 20%, 50%, or 75%, by using an image forming apparatus having a developer tank of a trickle system modified from a commercially available apparatus (trade name: AR450, a two-component developing system, manufactured by Sharp Corporation) (a developing bias: −300 V, referred to as a "comparative apparatus" in Table 1 as shown below), and a modified apparatus in which a developing device of a commercially available image forming apparatus (trade name: MX6200N, a two-component developing system, manufactured by Sharp Corporation) was replaced with the developing device 10 (a developing bias: −300 V, referred to as an "apparatus of the technology" in Table 1 as shown below). The obtained black solid images were observed by eyes with respect to non-uniformity on the image from the non-uniform mixture in the developer tank, and evaluated based on the following criteria.

Good: No non-uniformity is observed with careful observation.

Available: Non-uniformity is slightly observed with careful observation.

Poor: Non-uniformity is observed with rough observation. The results are shown in Table 1.

TABLE 1

| | Black solid image print ratio (%) A4 | | | |
|---|---|---|---|---|
| | 10 | 20 | 50 | 75 |
| Comparative apparatus | Good | Good | Available | Poor |
| Apparatus of the technology | Good | Good | Good | Good |

Based on Table 1, it is evident that the developing device 10 prevents the non-uniformity from occurring.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device provided in an image forming apparatus including a photoreceptor, for supplying a toner onto an electrostatic latent image on the photoreceptor, comprising:

a developer bearing member rotatably provided so as to face the photoreceptor, for supplying the toner onto the electrostatic latent image on the photoreceptor;

a developer tank including a developing area tank having a length substantially equal to a length in an axis line direction of the developer bearing member, for supplying a developer to the developer bearing member, and an agitating tank provided so as to be connected to the developing area tank in a longitudinal direction of the developing area tank, the agitating tank having a toner replenishing port for receiving toner;

a first agitating member rotatably supported by the developer tank so as to face the developer bearing member, the first agitating member having a length longer than a length of the developer bearing member in its axis line direction, and being provided so that a first end thereof reaches a vicinity of an outer side end of the agitating tank in its longitudinal direction and having a second end thereof that reaches a vicinity of an outer side of the developing area tank opposite the agitating tank, the first agitating member agitating and transporting the developer from the first and second ends inwards toward the toner replenishing port;

a second agitating member rotatably supported by the developer tank so as to oppose the developer bearing member via the first agitating member, the second agitating member having a length longer than a length in the axis line direction of the developer bearing member, and being provided so that a first end thereof reaches a vicinity of the outer side end of the agitating tank and having a second end thereof that reaches a vicinity of the outer side of the developing area tank opposite the agitating tank, the second agitating member agitating the replenished toner along with the developer in the developer tank and transporting the mixture; and a toner hopper disposed so as to be connected to the developer tank, for supplying the developer tank with toner received from a toner storing container, the toner hopper having a a toner supplying port in communication with the toner replenishing port of the developer tank.

2. The developing device of claim 1, wherein the toner replenishing port is formed in a middle portion of a longitudinal direction of the agitating tank in the developer tank, and on an upper side of a vertical direction of the first agitating member.

3. The developing device of claim 1, wherein the second agitating member transports the developer in a direction opposite to the direction of transporting the developer by the first agitating member, in an area from an end of a longitudinal direction of the developing area tank to a vicinity of the toner replenishing port, and transports the developer in a direction identical to the direction of transporting the developer by the first agitating member, in an area from an end of a longitudinal direction of the agitating tank to the vicinity of the toner replenishing port.

4. The developing device of claim 1, wherein the first agitating member and the second agitating member are screw-shaped agitating members including a rotating shaft rotatably supported by the developer tank, and an agitating blade spirally formed on an outer peripheral surface of the rotating shaft so as to extend in an axis line direction of the rotating shaft.

5. The developing device of claim 4, wherein the first agitating member is a screw-shaped agitating member including:

a rotating shaft rotatably supported by the developer tank;

a first agitating blade formed on an outer peripheral surface of the rotating shaft so as to spirally extend from the second end of the first agitating member for transporting the developer by a rotation of the rotating shaft in a direction from the second end of the first agitating member towards the toner replenishing port; and a second agitating blade formed on an outer peripheral surface of the rotating shaft so as to spirally extend from the first end of the first agitating member for transporting the developer by the rotation of the rotating shaft in a direction from the first end of the first agitating member towards the toner replenishing port.

6. The developing device of claim 4, wherein the second agitating member is a screw-shaped agitating member including:

a rotating shaft rotatably supported by the developer tank;

a third agitating blade formed on an outer peripheral surface of the rotating shaft so as to spirally extend from the second end of the second agitating member for transporting the developer by the rotation of the rotating shaft in the direction from the toner replenishing port to the second end of the second agitating member; and the fourth agitating blade formed on the outer peripheral surface of the rotating shaft so as to spirally extend from the first end of the second agitating member for transporting the developer by the rotation of the rotating shaft in a direction from the toner replenishing port to the first end of the second agitating member.

7. The developing device of claim 6, wherein the third agitating blade is wound in a direction opposite to the fourth agitating blade.

8. The developing device of claim 7, wherein an inner end of the third agitating blade meets an inner end of the fourth agitating blade at a position adjacent the toner replenishing port.

9. The developing device of claim 1, wherein the developer tank and the toner hopper are provided in this order in a connected manner in the vertical direction, and the developer tank is disposed lowermost in the vertical direction.

10. The developing device of claim 1, wherein the developer tank includes a developer discharging port formed for discharging the developer to an outside of the developer tank, and wherein the toner supplied to the developer tank through the toner replenishing port contains a carrier.

11. An image forming apparatus comprising:

a photoreceptor that is configured to form an electrostatic latent image formed on a surface thereof;

a charging section for charging the surface of the photoreceptor;

an exposure section for forming the electrostatic latent image on the surface of the photoreceptor;

the developing device of claim 1, for supplying a toner onto the electrostatic latent image on the surface of the photoreceptor to form a toner image;

a transfer section for transferring the toner image on the surface of the photoreceptor onto a recording medium;

a cleaning section for cleaning up the surface of the photoreceptor; and a fixing section for fixing the toner image onto the recording medium.

12. The developing device of claim 1, wherein rotation of the first agitating member causes a pulsating movement of the developer in the agitating tank beneath the toner replenishing port such that the developer moves upward into the toner hopper and then back down into the agitating tank.

13. The developing device of claim 1, wherein the first agitating member comprises:

a rotating shaft that is rotatably mounted on the developer tank;

a first agitating blade portion formed on the rotating shaft that moves developer in the developer area tank towards the toner replenishing port; and a second agitating blade portion formed on the rotating shaft that moves developer in the agitating tank towards the toner replenishing port.

14. The developing device of claim 13, wherein the first and second agitating blade portions are spiral shaped blades formed on the exterior of the rotating shaft, and wherein the first agitating blade portion is wound in a direction opposite to the second agitating blade portion.

15. The developing device of claim 14, wherein an inner end of the first agitating blade portion meets an inner end of the second agitating blade portion under the toner replenishing port.

16. The developing device of claim 1, further comprising a toner storing container having a toner discharge port for discharging a stored toner to an outside thereof, and wherein the toner hopper receives toner discharged through the toner discharge port of the toner storing container.

* * * * *